US007416335B2

(12) United States Patent
Munger

(10) Patent No.: US 7,416,335 B2
(45) Date of Patent: Aug. 26, 2008

(54) MAGNETICALLY SHIELDED X-RAY TUBE

(75) Inventor: Gareth T. Munger, St. Louis, MO (US)

(73) Assignee: Sterotaxis, Inc., St. Louis, MO (US)

( * ) Notice: Subject to any disclaimer, the term of this patent is extended or adjusted under 35 U.S.C. 154(b) by 155 days.

(21) Appl. No.: 11/484,885

(22) Filed: Jul. 11, 2006

(65) Prior Publication Data

US 2007/0030958 A1 Feb. 8, 2007

Related U.S. Application Data

(60) Provisional application No. 60/699,570, filed on Jul. 15, 2005.

(51) Int. Cl.
*H01J 35/16* (2006.01)

(52) U.S. Cl. ..... 378/203

(58) Field of Classification Search ..... 378/203
See application file for complete search history.

(56) References Cited

U.S. PATENT DOCUMENTS

| | | | |
|---|---|---|---|
| 5,654,864 | A | 8/1997 | Ritter et al. |
| 5,931,818 | A | 8/1999 | Werp et al. |
| 6,014,580 | A | 1/2000 | Blume et al. |
| 6,015,414 | A | 1/2000 | Werp et al. |
| 6,128,174 | A | 10/2000 | Ritter et al. |
| 6,148,823 | A | 11/2000 | Hastings |
| 6,152,933 | A | 11/2000 | Werp et al. |
| 6,157,853 | A | 12/2000 | Blume et al. |
| 6,212,419 | B1 | 4/2001 | Blume et al. |
| 6,241,671 | B1 | 6/2001 | Ritter et al. |
| 6,292,678 | B1 | 9/2001 | Hall et al. |
| 6,296,604 | B1 | 10/2001 | Garibaldi et al. |
| 6,298,257 | B1 | 10/2001 | Hall et al. |
| 6,304,768 | B1 | 10/2001 | Blume et al. |
| 6,315,709 | B1 | 11/2001 | Garibaldi et al. |
| 6,330,467 | B1 | 12/2001 | Creighton, IV et al. |
| 6,352,363 | B1 | 3/2002 | Munger et al. |
| 6,364,823 | B1 | 4/2002 | Garibaldi et al. |
| 6,373,921 | B1 * | 4/2002 | Kliman et al. ..... 378/131 |
| 6,375,606 | B1 | 4/2002 | Garibaldi et al. |
| 6,385,472 | B1 | 5/2002 | Hall et al. |
| 6,401,723 | B1 | 6/2002 | Garibaldi et al. |
| 6,428,551 | B1 | 8/2002 | Hall et al. |
| 6,459,924 | B1 | 10/2002 | Creighton, IV et al. |
| 6,505,062 | B1 | 1/2003 | Ritter et al. |

(Continued)

OTHER PUBLICATIONS

Modern Magnetic Materials, Principles and Applications Robert C. O'Handley John Wiley & Sons, Inc. 2002—(1 page).

*Primary Examiner*—Chih-Cheng G Kao
(74) *Attorney, Agent, or Firm*—Harness, Dickey & Pierce, P.L.C.

(57) ABSTRACT

Methods of designing an x-ray tube shielded for operation in static and dynamic externally applied magnetic fields are described. The methods include passive shielding of the insert frame, housing, design of an external shield envelope, tube port, tube collimator, and combinations thereof. The resulting x-ray tube devices are appropriate for use in a variety of applications ranging from magnetic navigation with x-ray monitoring and guidance for interventional procedures to multi-modality imaging and interventional procedures using an x-ray system in the vicinity of an MRI system.

4 Claims, 11 Drawing Sheets

U.S. PATENT DOCUMENTS 6,507,751 B2 1/2003 Blume et al.
6,522,909 B1 2/2003 Garibaldi et al.
6,524,303 B1 2/2003 Garibaldi
6,527,782 B2 3/2003 Hogg et al.
6,537,196 B1 3/2003 Creighton, IV et al.
6,542,766 B2 4/2003 Hall et al.
6,562,019 B1 5/2003 Sell
6,630,879 B1 10/2003 Creighton, IV et al.
6,658,085 B2 12/2003 Sklebitz
6,662,034 B2 12/2003 Segner et al.
6,677,752 B1 1/2004 Creighton, IV et al.
6,702,804 B1 3/2004 Ritter et al.
6,733,511 B2 5/2004 Hall et al.
6,755,816 B2 6/2004 Ritter et al.
6,810,110 B2 10/2004 Pelc et al.
6,817,364 B2 11/2004 Garibaldi et al.
6,834,201 B2 12/2004 Gillies et al.
6,902,528 B1 6/2005 Garibaldi et al.
6,911,026 B1 6/2005 Hall et al.
6,968,846 B2 11/2005 Viswanathan
6,975,197 B2 12/2005 Creighton, IV
6,980,843 B2 12/2005 Eng et al.
7,008,418 B2 3/2006 Hall et al.
7,010,338 B2 3/2006 Ritter et al.
7,019,610 B2 3/2006 Creighton, IV et al.
7,020,512 B2 3/2006 Ritter et al.
7,066,924 B1 6/2006 Garibaldi et al.
2001/0038683 A1 11/2001 Ritter et al.
2002/0019644 A1 2/2002 Hastings et al.
2002/0177789 A1 11/2002 Ferry et al.
2004/0006301 A1 1/2004 Sell et al.
2004/0019447 A1 1/2004 Shachar
2004/0064153 A1 4/2004 Creighton, IV et al.
2004/0068173 A1 4/2004 Viswanathan
2004/0096511 A1 5/2004 Harburn et al.
2004/0133130 A1 7/2004 Ferry et al.
2004/0157082 A1 8/2004 Ritter et al.
2004/0158972 A1 8/2004 Creighton, IV et al.
2004/0186376 A1 9/2004 Hogg et al.
2004/0199074 A1 10/2004 Ritter et al.
2004/0249262 A1 12/2004 Werp et al.
2004/0249263 A1 12/2004 Creighton, IV
2004/0260172 A1 12/2004 Ritter et al.
2005/0020911 A1 1/2005 Viswanathan et al.
2005/0043611 A1 2/2005 Sabo et al.
2005/0065435 A1 3/2005 Rauch et al.
2005/0096589 A1 5/2005 Shachar
2005/0113628 A1 5/2005 Creighton, IV et al.
2005/0113812 A1 5/2005 Viswanathan et al.
2005/0119687 A1 6/2005 Dacey, Jr. et al.
2005/0182315 A1 8/2005 Ritter et al.
2005/0256398 A1 11/2005 Hastings et al.
2006/0009735 A1 1/2006 Viswanathan et al.
2006/0025679 A1 2/2006 Viswanathan et al.
2006/0036125 A1 2/2006 Viswanathan et al.
2006/0036163 A1 2/2006 Viswanathan
2006/0041178 A1 2/2006 VIswanathan et al.
2006/0041179 A1 2/2006 Viswanathan et al.
2006/0041180 A1 2/2006 Viswanathan et al.
2006/0041181 A1 2/2006 Viswanathan et al.
2006/0041245 A1 2/2006 Ferry et al.
2006/0058646 A1 3/2006 Viswanathan
2006/0074297 A1 4/2006 Viswanathan
2006/0079745 A1 4/2006 Viswanathan
2006/0079812 A1 4/2006 Viswanathan
2006/0093193 A1 5/2006 Viswanathan
2006/0094956 A1 5/2006 Viswanathan
2006/0100505 A1 5/2006 Viswanathan
2006/0114088 A1 6/2006 Shachar
2006/0116633 A1 6/2006 Shachar
2006/0144407 A1 7/2006 Aliberto et al.
2006/0144408 A1 7/2006 Ferry

* cited by examiner

MAGNETICALLY SHIELDED X-RAY TUBE

CROSS-REFERENCE TO RELATED APPLICATIONS

This application claims the benefit of U.S. Provisional Patent Application Ser. No. 60/699,570, filed Jul. 15, 2005, the entire disclosure of which is incorporated herein by reference.

FIELD

This invention relates to the field of x-ray tube design, and more particularly to a method of shielding x-ray tubes from externally applied static and dynamic magnetic fields.

BACKGROUND

As an increasing number of medical interventions call for multi-modality imaging, such as combined x-ray and magnetic resonance imaging (MRI), the design of x-ray systems must be adapted to allow for operation in a high magnetic field. In an MRI imaging environment, small magnitude high-frequency time-varying field gradients are superimposed to a large static field with a magnitude of several Tesla; usually only the static field is to be considered for shielding purposes when operating an x-ray system in the vicinity of an MRI system.

Other applications where compatibility of an x-ray imaging system with applied external magnetic fields is required include interventional radiology and cardiology, where a patient is positioned on a table within an operating and imaging region during the procedure. In a magnetic navigation procedure, a variable magnetic field is applied to guide the progress of a guide wire, guide catheter, sheath, or catheter, to enable easier navigation of such medical devices through the patient's vasculature. In the environment outside but nearby the navigation volume the magnetic fields are typically of a magnitude of a few tenths of a Tesla or smaller but vary throughout the procedure in an apparently unpredictable manner as dictated by the navigation needs. The direction and magnitude of the external field present around the navigation region and immersing the x-ray system can thus dynamically evolve in a time scale comparable to that of the x-ray imaging chain image acquisition sequence.

Normal operation of an x-ray radiographic or fluoroscopic system in a magnetic environment requires magnetic compatibility. In particular, the x-ray imaging chain, including the tube and detector, must include specific design considerations to enable high-quality robust imaging while being operated in a time and spatially variant magnetic field.

One of the key components to consider for magnetic compatibility is the x-ray source. In most imaging x-ray systems, an electron beam is accelerated from a cathode to a metal target anode through the application of a high-voltage potential difference; x-rays are produced by the subsequent deceleration of the electrons upon hitting the anode target material. In the presence of a magnetic field the beam electrons will experience a force (the Lorentz force) when a component of the magnetic field is perpendicular to the direction of electron motion. The Lorentz force deflects the electron beam and moves the electron focal spot (where the electrons hit the metal target) position on the anode; as a result the x-ray source location is shifted. Such x-ray source shifts are magnified by the x-ray system source-collimator-detector geometry and produce associated image shifts; accordingly the projection of a static object appears to be moving when imaged in a variable magnetic field. To the physician these types of artifactual image shifts are unacceptable.

Another source of image shift comes from the forces applied on the overall x-ray tube by the external magnetic and gravitational fields. In magnetic field magnitudes of 0.1 Tesla or less, the magnetic force is sufficient to induce flexing of the mechanical components that support the x-ray tube. The directions of the applied forces depend on the relative orientation of the x-ray tube and supporting structures with respect to the magnetic and gravitational fields. The resulting forces and torques on the image chain components can also create undesirable image shifts through differential flex behaviors of the x-ray tube and collimation sub-systems, and induce shifts in the relative geometry between the patient and the x-ray image chain. Such shifts can compromise the accuracy of three-dimensional (3D) spatial information derived from the x-ray projections and also can complicate or render unfeasible the task of registering the projection data to a previously acquired 3D data set.

SUMMARY

The present invention describes methods of shielding x-ray imaging components, including x-ray tubes, from externally applied static or dynamic magnetic fields. The resulting devices and apparatuses are less sensitive to the presence of such fields, and are appropriate for use in multi-modality applications and integration in supporting systems. The resulting shielded x-ray tubes provide robust operation in various types of externally applied magnetic fields; the degree of insensitivity to a field of a given magnitude being dependent upon parameters of the design methods described herein.

To prevent Lorentz force induced image shifts, the magnitude of the magnetic field at the tube electron beam must be reduced. To accomplish this, in U.S. Pat. No. 6,352,363 issued to Munger and Werp an external shell is described that is composed of a magnetically permeable material and closely surrounds the x-ray tube housing. While this approach can work and allow for the integration of such a modified tube within a magnetic field environment without modifying the extant x-ray tube housing or x-ray tube insert, in some cases the resulting shield is insufficient; additionally there maybe mechanical obstructions and other mechanical considerations that prevent practical implementation of such an approach.

X-ray tube housings have multiple feed-throughs to supply high voltages to the x-ray tube insert, oil exchange circuitry to allow the inflow of cold oil and outflow of hot oil for heat dissipation, and an x-ray transmission port to let the generated x-ray radiation propagate outside the tube in specified directions. These feed-throughs and associated tubing can lead to a complex geometry for the design of an external magnetic shield; the associated mechanical interferences can render design of an external shield impractical.

An additional limitation of such an approach is that an external shell tends to be bulky and adds significantly to the overall tube weight. The mechanical structure supporting the tube might not be of sufficient strength to allow for safe operation or might otherwise bend more than desirable under the additional load. Compounding such flex issues is the fact that the typically large shell structure will also be subjected to additional magnetic forces that might add to the gravitational forces and induce further stresses on the mechanical support structure.

Magnetically it is more efficient to reduce the diameter of the shield for the same thickness of permeable shielding material. This approach provides higher attenuation of the externally applied magnetic source and also allows for lower shielding weight and reduced magnetically induced forces and moments. Accordingly it is desirable to modify the x-ray tube housing or the x-ray tube insert.

Typical x-ray tubes also feature a fairly large x-ray port aperture. Such a large port allows a tube to be used on a number of different systems and for a variety of applications and geometries; an external beam collimator further shapes the radiation beam as required. However large ports also leave paths open for the external magnetic field to penetrate the tube and affect the magnetic properties of the volume in between the anode and cathode where the tube electron beam is susceptible to Lorentz forces.

The present invention describes methods of designing an x-ray tube with an insulating shield, a modified housing, a modified x-ray tube insert, and combinations thereof. Additional aspects of the present invention relate to the design of spacers for field attenuation and to the design of x-ray ports, scatter-rejecting tube cones, and tube-collimator assemblies.

In one embodiment of the present invention, a method is described for the design of an x-ray tube for robust operation in varying magnetic fields of the order of a few tenths of a Tesla, as appropriate for use in a magnetic navigation system.

According to another embodiment of the present invention, a method is described for the design of an x-ray tube for robust operation in magnetic fields of the order of a few Tesla. Such a tube is appropriate for use in multi-modality imaging environments comprising use of high-field MRI systems.

BRIEF DESCRIPTION OF THE DRAWINGS

Corresponding reference numerals indicate corresponding points throughout the several views of the drawings.

DETAILED DESCRIPTION

Figure 1:
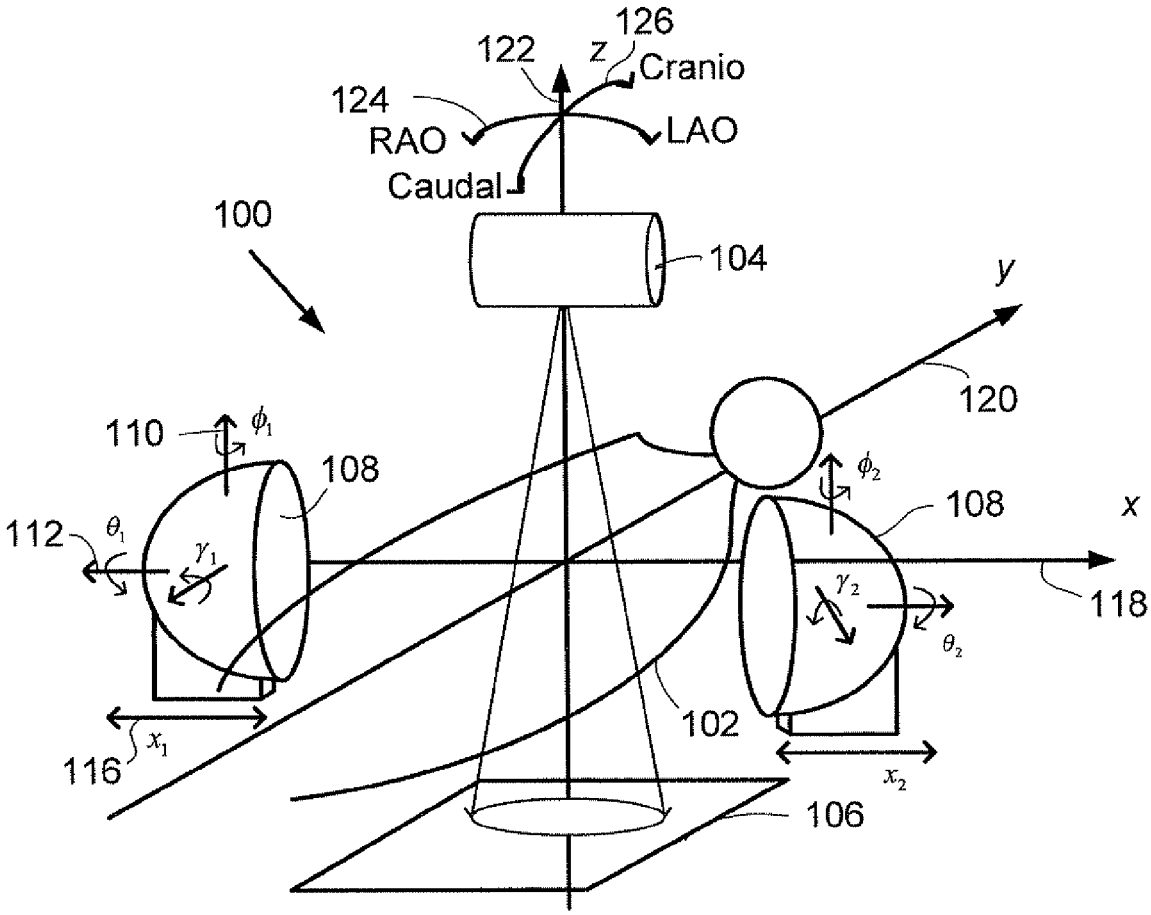
FIG. 1 shows an x-ray imaging system positioned nearby a magnetic navigation system within an interventional suite.

FIG. 1 describes a patient 102 positioned into a real-time projection imaging system 100 such as an x-ray fluoroscopy imaging chain and a magnetic navigation system for interventional applications. Magnetic navigation provides an effective means of guiding the progression of an interventional medical device such as a guide wire, guide catheter, sheath, or catheter, within the vasculature of a patient. As shown in FIG. 1, a magnetic navigation system may use a plurality of external and adjustable magnets 108 to generate a magnetic field of specified orientation and magnitude within an operating volume in the patient. The generated magnetic field exerts forces and torques on interventional devices to help navigation. It is common for magnetic navigation to also use x-ray imaging, either in a radiographic or fluoroscopic mode, to help keep the physician apprised of the progress of the interventional device and its relative position and orientation with respect to a specific target such as an arterial stenosis, a chronic occlusion, an aneurysm, or a heart chamber. To enhance navigation capability, it is desirable to position the x-ray imaging system nearby the operational volume; the physician may also want to acquire a multiplicity of projections by rotating the x-ray imaging chain with respect to the main table axis y 120 (left-anterior oblique or right-anterior oblique rotations 124), or by inclining the imaging chain with respect to a cross sectional plane (x 118, z 122) (cranio-caudal adjustments 126). The magnetic fields generated by the magnets are typically of the order of 0.1 Tesla or less at and in a region around the navigation target point and decrease in magnitude away from that point; the field magnitude at the edges of the navigation volume is of the order of 60 mT. The fields thus generated also exert mechanical forces and torques on the various components immersed in the field; as an example, one of two magnet pods 108 of the navigation system illustrated in FIG. 1 exerts a force of about 200 lbs on the other pod when separated by a distance of about 24 inches. The force exerted on a typical x-ray tube 104 is also considerable and can lead to flexing of the supporting structure; as an example, flexing of 5 mm or more has been noted for a C-arm mounted x-ray tube used in a magnetic navigation system similar to that illustrated in FIG. 1 (Niobe, Stereotaxis Inc.). As illustrated in FIG. 1, the two magnets have a number of degrees of freedom, including translation along an axis 116 parallel to the x axis, and rotations with respects to three rotation axes 110 and 112. The magnetic fields generated inside the x-ray tube interfere with the electron beam optics and induce shifts in the x-ray focal spot position; such focal spot shifts in turn are magnified by the geometry of the x-ray imaging system and lead to significant image shifts at the x-ray detector 106. Thus, scalable field strengths and variable field orientations induce various image offsets and dynamic shifts, and as a result the image of a static object within the patient appears moving, an effect unacceptable to the physician. The variations in field magnitude and orientation as present within the x-ray tube insert are generated by both the temporal field variations as necessary for magnetic navigation and the motion of the x-ray imaging chain in spatially varying fields.

Figure 2:
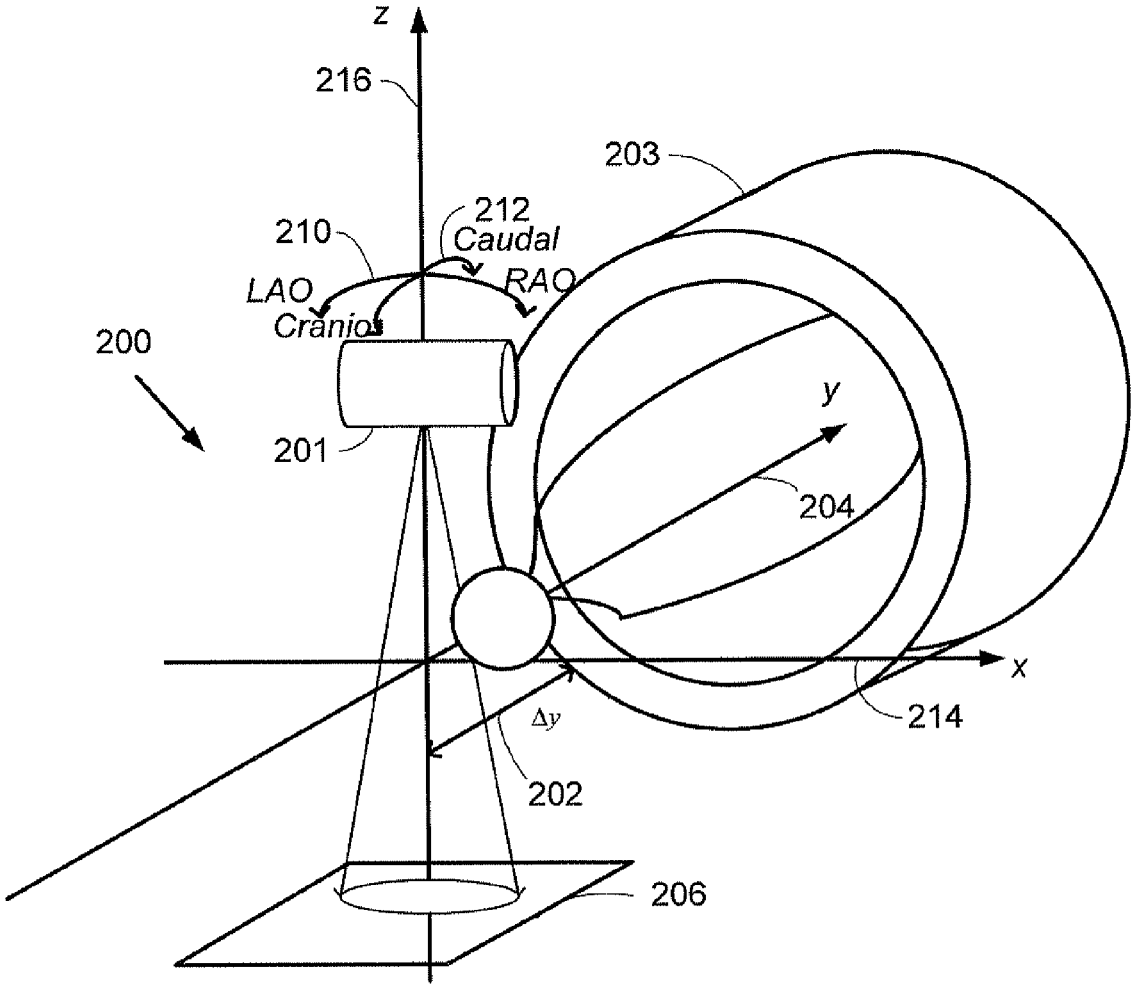
FIG. 2 presents an x-ray imaging system positioned in the vicinity of an MRI system within an imaging or interventional suite.

As illustrated in FIG. 2, a related situation occurs in multi-modality medical imaging 200, where an x-ray imaging system is positioned in the vicinity of an MRI system 203. In an MRI system, small field gradients operating at radio-frequencies are superimposed onto a large static field, Typically, only the static field needs to be considered for shielding of the x-ray system. Large fields of this magnitude are known to exert significant forces on metallic objects and also present related safety hazards. Although in modern high-field strength systems active shielding devices are used so that the field magnitude decreases rapidly away from the magnet bore, the resulting large field magnitude gradients pose significant problems when rotating (210, 212) about axis 204, 214, and 216 or repositioning an x-ray tube 201 and detector 206 of the imaging system of FIG. 2 in the MRI vicinity. Typically a minimum clearance distance .DELTA.y 202 is required for safe and robust operation of an x-ray imaging system in an MRI imaging room. The variations in field magnitude and orientation as seen at the x-ray tube insert are generated predominantly by the motion of the x-ray imaging chain in the MRI spatially varying field; however safety design considerations also require analysis of the time varying fields that could result from loss of superconductivity (quenching) or other similar events possible with active electromagnets.

Magnetic fields can be redirected by the use of shields. This is achieved with high permeability shielding alloys. Permeability can be thought of, heuristically, as an indication of how well a material can conduct a magnetic field. Magnetic shields use their high permeability to attract magnetic fields and divert the magnetic energy through the shield material. Shielding effectiveness is a function of the field intensity and of the degree to which the field lines are intercepted by the device to be shielded (this being affected by the volume to be shielded in a given field). Thicker shields can redirect stronger fields. In a simplistic approximation the field attenuation induced by a shield can be characterized by the equation: Attenuation $\propto {}^{\mu \times t}/_{D}$, where t is the shield thickness, μ is the material permeability, and D represents the shield diameter or diagonal extent. A shield works best when providing a complete path for the redirection of the field lines: an enclosed shield is preferable; gaps and openings reduce the shield effectiveness. It is also preferable to keep the shield from touching the part to be shielded. There is no known material that blocks magnetic fields without being itself attracted to the magnetic force; accordingly any added shield material will also lead to additional mechanical forces exerted by the resulting magnetic moment.

Figure 3:
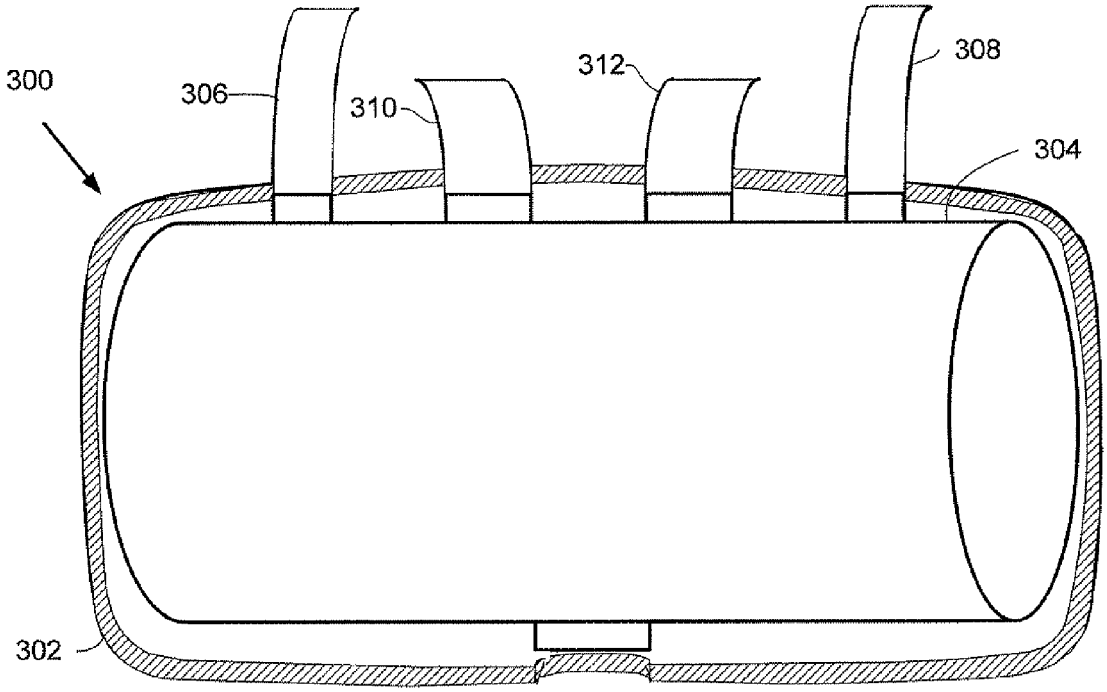
FIG. 3 illustrates an external x-ray tube shield.

A first approach to shielding an x-ray tube from externally applied fields is illustrated at 300 in FIG. 3. This approach was disclosed in U.S. Pat. No. 6,352,363 issued to Munger and Werp. A cast shield 302 of an iron based material is made to substantially enclose and closely conform to the shape of an x-ray tube 304. It was experimentally determined that internal fields at the x-ray tube anode-cathode of 50 Gauss or less do not lead to significant image artifacts or tube malfunctions. At external fields of magnitude of 800 Gauss a cast iron thickness of ¼ inch is sufficient to reduce the field to less than 50 Gauss. Although the approach is effective, the resulting shield is relatively heavy and subject to significant magnetic moments. Openings in the shield necessary to allow passage of the high-voltage (HV) cables 306, 308, and oil exchange tubes 310 and 312 do not significantly degrade the shield efficiency, particularly when located away from the magnetic source; however, the related design constraints might render practical design difficult. Further, shielding for a higher applied magnetic field would require additional material thickness which in turn would compound the mechanical stresses induced by both gravity and magnetic forces.

U.S. Pat. No. 6,810,110 issued to Pelc et al. discloses a means of actively reducing the sensitivity of an x-ray tube to external fields; this is achieved by positioning permanent magnets or electromagnets behind the anode and cathode respectively to produce a strong, properly aligned internal magnetic field. The x-ray tube also comprises electromagnetic coils that are arranged to oppose a transverse magnetic field. The x-ray tube is thus less sensitive to other magnetic fields that are not parallel to the anode-cathode axis. The x-ray tube can also be mounted such that a torque can be sensed. This sensed mechanical force is then used as an input to determined current applied to electromagnetic coils arranged to oppose a transverse magnetic field.

U.S. Pat. No. 6,658,085 issued to Sklebitz discloses an x-ray system that has sensors for the acquisition of the location dependency of stray magnetic fields in three spatial axes, and coils for compensation of the stray field, and a computer that uses the output signal of the sensors to calculate a current for the coils which cause the stray field to be reduced in the region of the electron beams of the x-ray tube.

Although the patents above referenced disclose active methods and means of shielding an x-ray tube through the use of compensatory magnetic fields, none of these patents teach nor suggest methods or means of actively compensating for the effect of a magnetic field through the use of an electrostatic system.

Further, implementation of the active shielding methods taught by these patents is relatively complex, and any active component is susceptible to failure or malfunction. Accordingly, further methods of passively shielding an x-ray tube are desirable.

Figure 4:
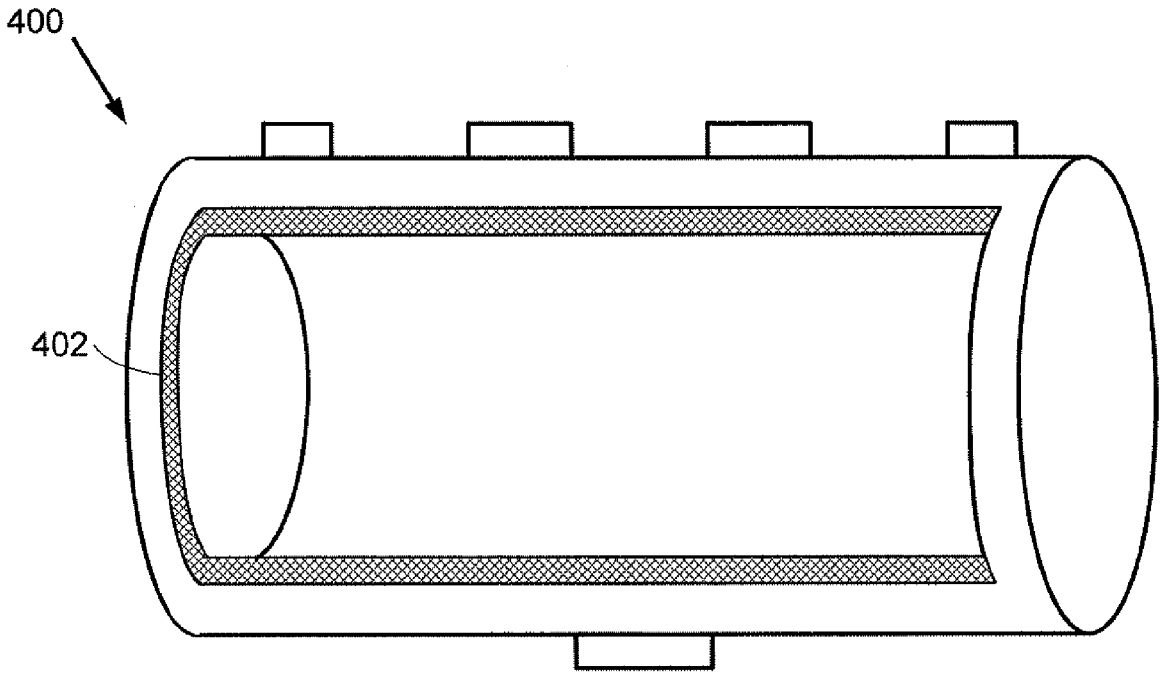
FIG. 4 shows an x-ray tube with a modified housing.

It is desirable to design the x-ray tube housing from a material suitable for magnetic shielding. The material must be chosen to meet the magnetic field attenuation requirements as well as to enable normal housing functionality, which includes x-ray shielding, feeding the HV to the insert, providing the tube current (mA) to the cathode as well as to the stator, collecting mA from the anode, providing electrical insulation, enabling insert anode rotation and insert cooling, performing x-ray beam pre-collimation, and including safety sensors. The x-ray tube housing can be manufactured out of a low-carbon steel, permalloy (Ni—Fe), Hiperco (Ni—Co—Fe) or isotropic Si-Steel. Low carbon steel materials include AISI 1008 (0.8 wt % carbon content); also available are 1004 and 1006 materials. High carbon content reduces magnetic saturation and permeability. A 6 mm thick low carbon magnetically permeable steel (such as an ST12 steel alloy) was found adequate for shielding a field of magnitude up to 60 mT, for instance in the Siemens Axiom Artis dFC MN X-ray system. Advantages of this approach include preservation of the original design tube feed-throughs, apertures, and of the original design shape of the x-ray tube housing which may have favorable geometric shape and thermal properties. However, each of the original tube feed-throughs, apertures, and sharp corners allows for magnetic leakage into the electron beam area of the x-ray tube. Ideally the magnetic shield would have the least number of openings and be of a shape that allows for the channeling of magnetic flux. Ideally the shape would be a cylinder with radiused joints between the edge and the ends, or a long ellipsoid. Alternatively the housing design, including shape and apertures, may be revisited to account for the shielding requirements and specific material considerations. The reduced tube envelope volume, as compared to the external tube shield approach, is also favorable from a mechanical exclusion volumes perspective, particularly in a tight environment typical of multi-modality systems. FIG. 4 illustrates 400 the use of a magnetic shield material 402 for the design of an x-ray tube housing.

Figure 5:
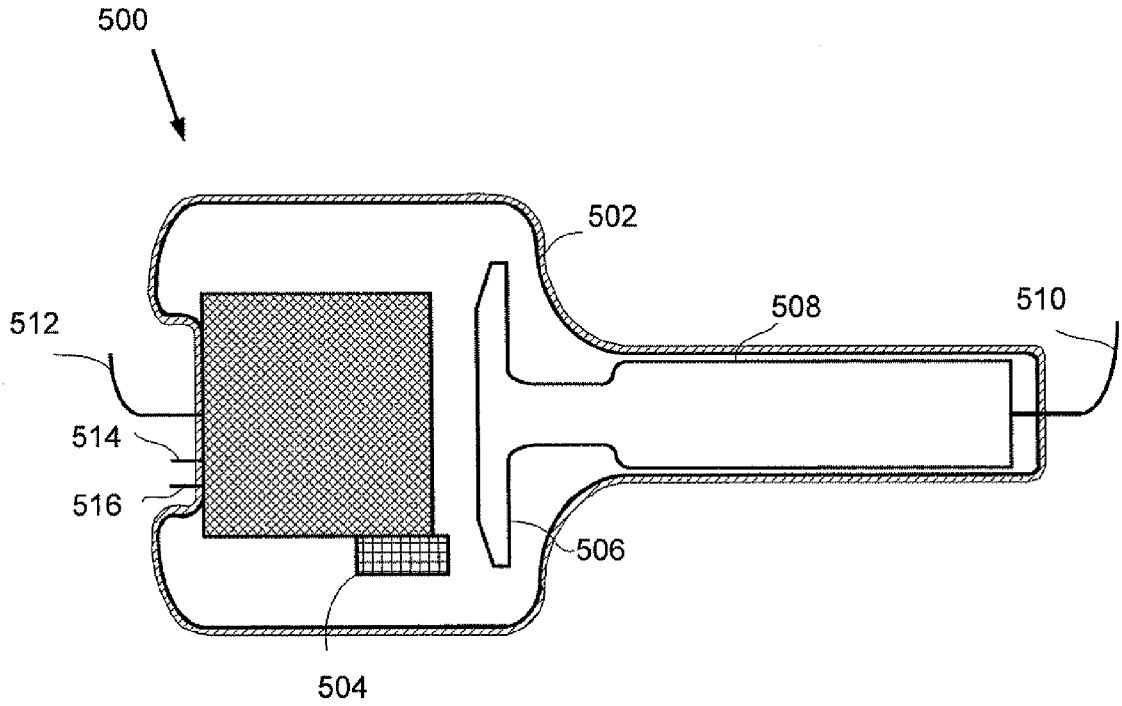
FIG. 5 presents an x-ray tube with a modified insert.

As previously mentioned, magnetically it is more efficient to reduce the diameter of the shield for the same thickness of permeable shielding material. Not only does this approach allow for higher attenuation of the externally applied magnetic source, as fewer field lines are intercepted by the shield, but it allows for lower shielding weight. A low shield weight is desirable since x-ray tubes magnetically shielded with an external envelope have a higher weight than a standard x-ray tube; to prevent any modification to the C-arm mechanics it is favorable for the weight of magnetically shielded tubes to be similar to that of the standard tubes. A reduction in the shielded x-ray tube mass also reduces the magnetic force interaction between the shield and the external magnetic source. This interaction can produce forces and torque on the magnetic x-ray tube shield that must be mechanically stabilized by the supporting structure. Thus ideally the x-ray tube insert frame would be made of a magnetically permeable material, as illustrated in FIG. 5, 500. The x-ray tube insert frame material 502 must be chosen for a combination of magnetic, thermal, and mechanical properties, and must be such that the insert meets all functionality requirements, including maintaining a vacuum; positioning the cathode 504 in front of the anode 506; providing high-voltage insulation of the cathode and anode and associated feeds 512 and 510; providing power to the tube filament through electrodes 514 and 516; collecting electrons back scattered from the anode; enabling rotation of the anode assembly and stem 508; and providing an internal collimator and x-ray port. The material chosen must also retain the advantages of a stainless steel frame over a glass envelope, including strength, rigidity, decreased off-focal radiation (through backscattered electrons absorption); and increased heat transfer rate through emissive coating of the external frame surfaces. This approach was taken on the (Philips) Allura Xper FD10 with Niobe Interface X-ray system. The x-ray tube insert in this system is made from a higher permeably material but lower magnetic saturation than the low carbon steel that is used on the modified housing of the Niobe-Artis system. This Ni—Fe alloy is approximately 3.0 mm thick ("3.0 mm Permalloy") and has similar attenuation of the imposed magnetic field at the electron beam as the x-ray tube housing structure described above. Feed-throughs, apertures and sharp geometric features considerations relevant to the housing design also apply to the insert frame design. The magnetic moment induced by the use of a high permeability material can lead to deflection of a C-arm; accordingly it is desirable to specify the mechanical support device to account for these induced stresses, and to design the x-ray beam optics to minimize differential motions (such as that of the x-ray focal spot with respect to the collimator) that are magnified by the imaging chain.

In a material, high permeability translates into a high field reduction; the field lines are attracted by the high permeability material and are brought back to the source through the shield. The permeability is given by the slope of the B-H curve, where H represents the applied field magnitude and B the induction:

$$\mu = \frac{dB}{dH}.$$

The magnetic hardness of a material is given by the strength (defined as the product of the residual induction $B_r$ by the coercive field $H_c$: strength $=B_{r\times Hc}$) integrated in the $2^{nd}$ quadrant along the B versus H hysteresis curve (*Modern Magnetic Materials, Principles and Applications*, Robert C. O'Handley, John Wiley & Sons, Inc., 2002). Ideally a shield material has high permeability and no coercivity, and is therefore magnetically "soft." Unfortunately such soft materials often lack thermal and mechanical properties required to withstand the stresses applied to an x-ray tube insert, and to a lesser degree, an x-ray tube housing. Selected magnetically harder materials offer a combination of permeability and strength suitable for the insert; selected softer materials are appropriate for either the housing or for an external shield envelope design. When comparing materials with different B-H or permeability curves for the design of a magnetic shield, what matters is the integral of the attenuation as a function of the field seen at various layer depths in the shield.

Figure 6:
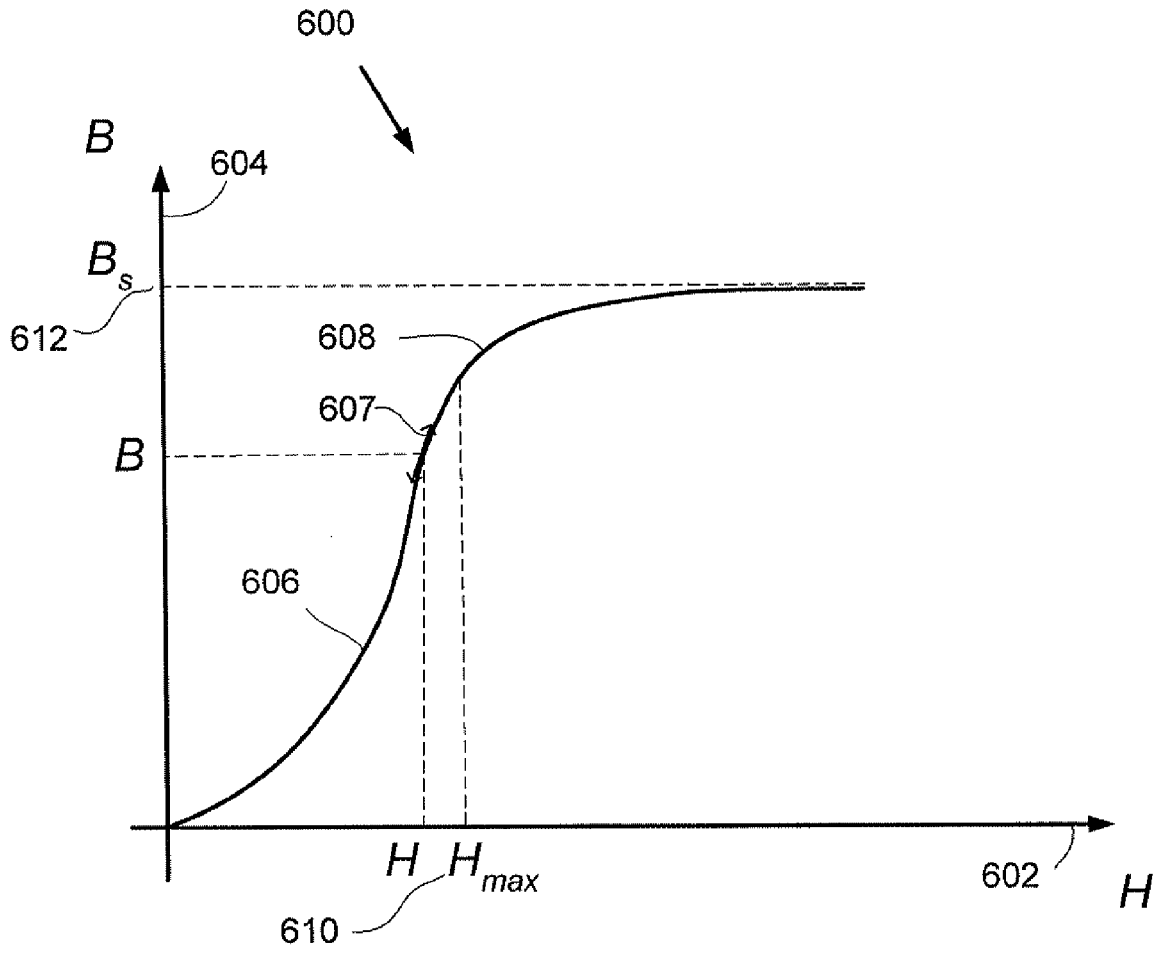
FIG. 6 illustrates a desirable shielding material B-H curve for a given range of external field magnitudes.

As the permeability is highly non-linear it is difficult to make accurate qualitative predictions. In all but a few of the simplest geometries the calculations cannot be done analytically and must be carried through a numerical analysis such as a finite element model (FEM) analysis. Such numerical analyses present difficulties, from the choice of the FEM element size to the sensitivity to errors in the permeability curves. These curves are obtained experimentally; the permeability of a material depends on the material chemical composition and also on physical conditions applied during material formation. The magnetic field boundary conditions determine the magnetic field inside a shield of any given shape; numerical analyses and experimentation show that openings for cables, tubes, and pods, have a relatively small local field impact but can have pervasive field effects inside the shielded volume. FIG. 6 illustrates 600 a B-H curve 606 and permeability $$\mu = \frac{dB}{dH}$$

Figure 7:
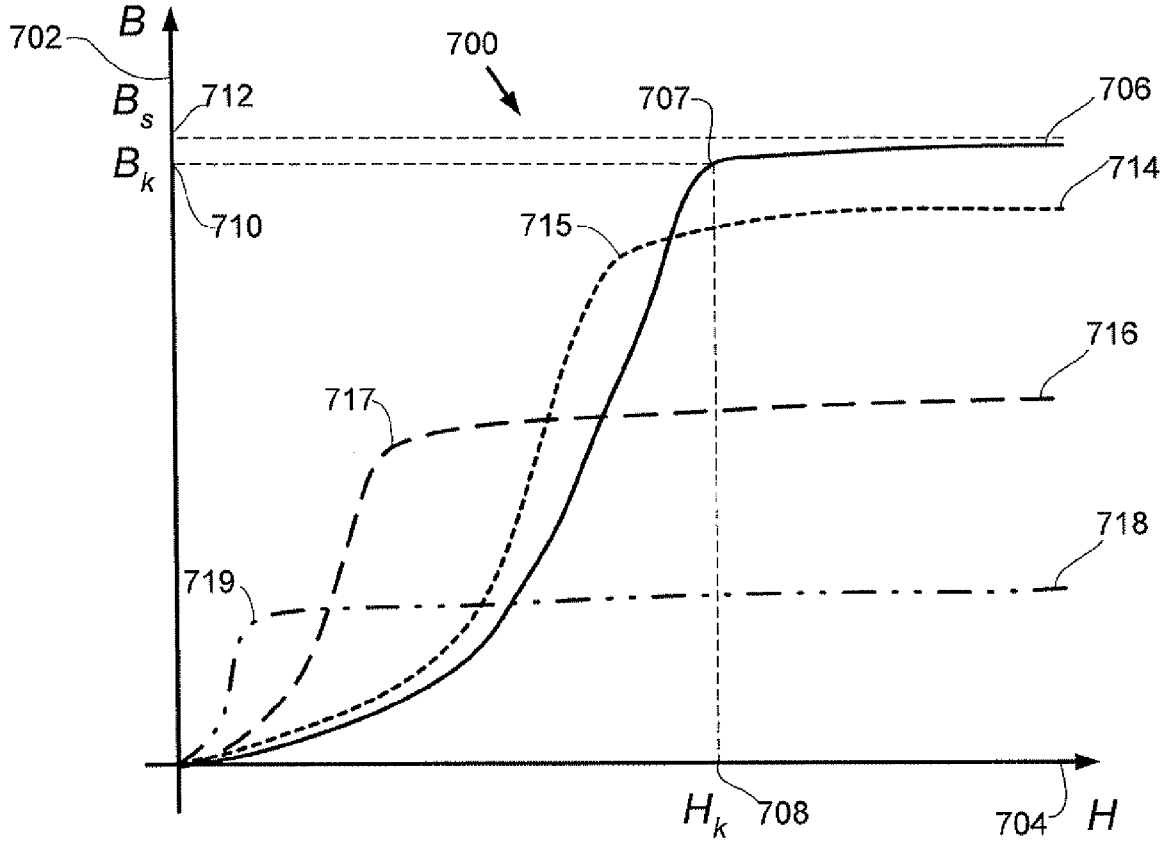
FIG. 7 illustrates B-H curves for various materials suitable for magnetic field attenuation and shielding.

07 (or induced field B along axis 604) for a range of field magnitudes H along axis 602. As the field progresses in the material, its magnitude is reduced in proportion to the local curve derivative μ(H). Accordingly the material of FIG. 6 is suitable for use as a shield for field magnitudes less than $H_{max}$, 610. FIG. 7 presents 700 B-H curves for a number of materials suitable for magnetic shielding. The applied field H (axis 704) leads to an induction field B (axis 702) in the material. Curve 706 is representative of the B-H curve and saturation point 712 and knee point 707 (708, 710) for Hiperco material; curve 714 and saturation point 715 for a low carbon steel material similar to that used for an x-ray tube housing; curve 716, representative for a lower saturation 717 and higher permeability material such as Permalloy used for an x-ray insert; and curve 718 and saturation point 719 is representative of a mu-metal material (a nickel-iron alloy with typically 77% nickel, 15% iron, plus copper and molybdenum).

The shielding efficiency can be enhanced by subdividing the magnetic material in layers separated by air gaps. Referring now to FIG. 6, as the permeability is given by the slope of the B-H curve, a shielding material should not be used in the high H region beyond the B-H curve knee 608 as the curve plateaus to an asymptotic magnetic saturation level $B_s$ 612 where the derivative vanishes and the material loses its shielding effectiveness. In general, the permeability of a material is inversely proportional to the material magnetic saturation induction $B_s$, $\mu \propto {}^1/B_s$. Referring now to FIG. 7, it is seen that materials of progressively reduced $B_s$ levels present higher B-H curves slopes (although in a reduced range of applied fields H). Thus in designing a layered shield, it is desirable to select for a first layer closest to the magnetic source a material with a relatively high saturation level such as Hiperco, 706; a second layer will see reduced fields and can therefore use a material of reduced saturation level and higher permeability such as Permalloy, 716.

Figure 8:
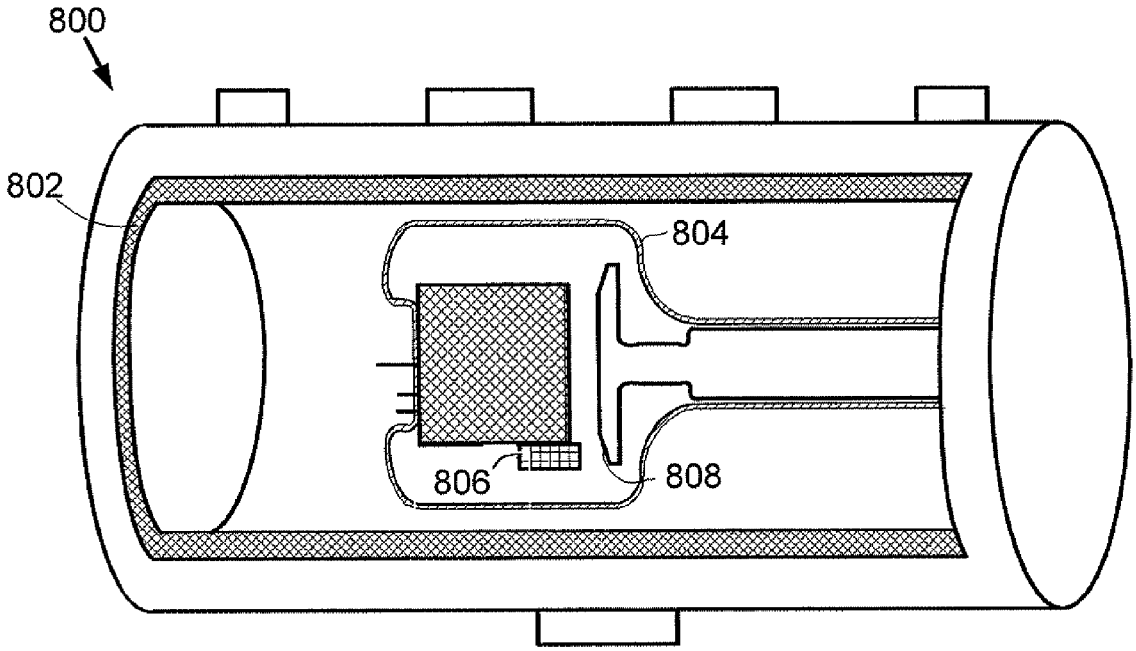
FIG. 8 shows a layering approach to shielding an x-ray tube cathode and anode sub-system.

Such an approach is illustrated in FIG. 8, 800. In FIG. 8 a combinative shielding approach is shown where a material of high saturation level 802 is retained for the tube housing. A harder material of reduced saturation level but of increased permeability, such as Permalloy, is retained for the tube insert 804. Such a choice is appropriate as due to the shielding action of the housing material, the insert will see only reduced field magnitudes below its material saturation level, even in the presence of high external fields such as generated by an MRI system. The reduced field present in the space between the cathode 806 and the anode 808 will be exposed to field magnitudes less than a threshold (such as 50 Gauss) suitable for robust imaging.

Figure 9:
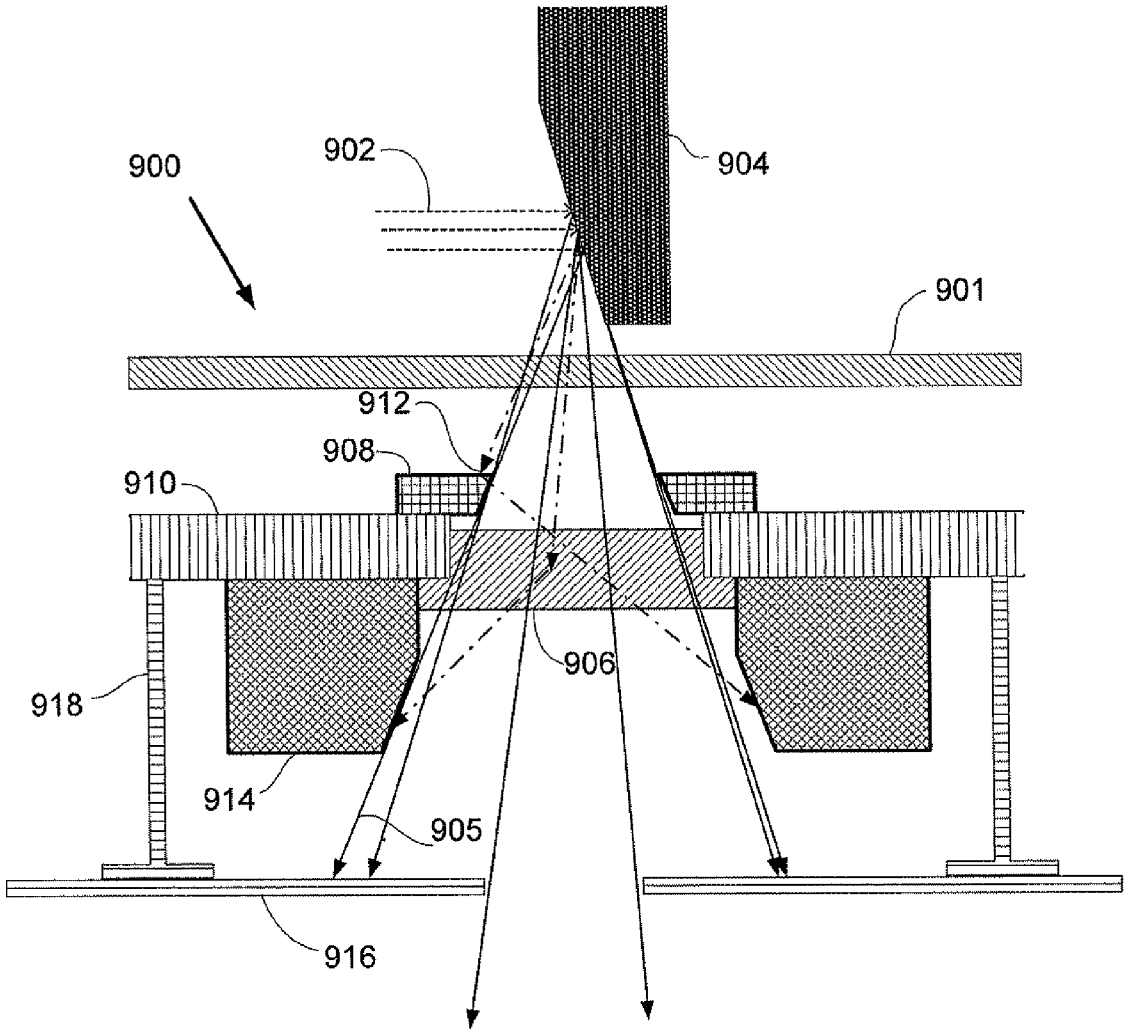
FIG. 9 presents a modified tube port and scatter-rejecting cone for operation of an x-ray tube in an external magnetic field.

It is also desirable to minimize the x-ray port aperture. Unfortunately magnetically permeable materials have high x-ray attenuation coefficients and thus cannot be placed in any amount significant for magnetic field attenuation across the x-ray exit port. The magnetic field will penetrate into the tube through the port and towards the beam. Most x-ray tubes also have a separate brass cone piece to attenuate x-ray scatter in this area. This cone piece shape and material composition can also be modified to reduce the magnetic leakage due to the aperture, as illustrated in FIG. 9. FIG. 9 presents a cross-section 900 of an x-ray tube showing part of the insert frame 901 and the electron beam 902 striking the anode 904. X-rays 905 are emitted near isotropically and a tube 910 housing pre-collimator 908 shapes the beam that passes through the window 906. The window is typically made of an alloy of aluminum and beryllium. X-rays scattered 912 within the tube, such as on the pre-collimator, are to some degree intercepted by an x-ray scatter cone 914. Both the pre-collimator 908 and the cone 914 typically present an axis of rotational symmetry. In specific applications it is desirable to design the x-ray collimator 916 such that the supporting assembly 918 encloses the tube port and provides a near continuous shield for the externally applied magnetic field; similar materials and layering as in the tube can be used. In some cases there may need to be extra thickness since the collimator can get physically closer to the magnets.

Figure 10:
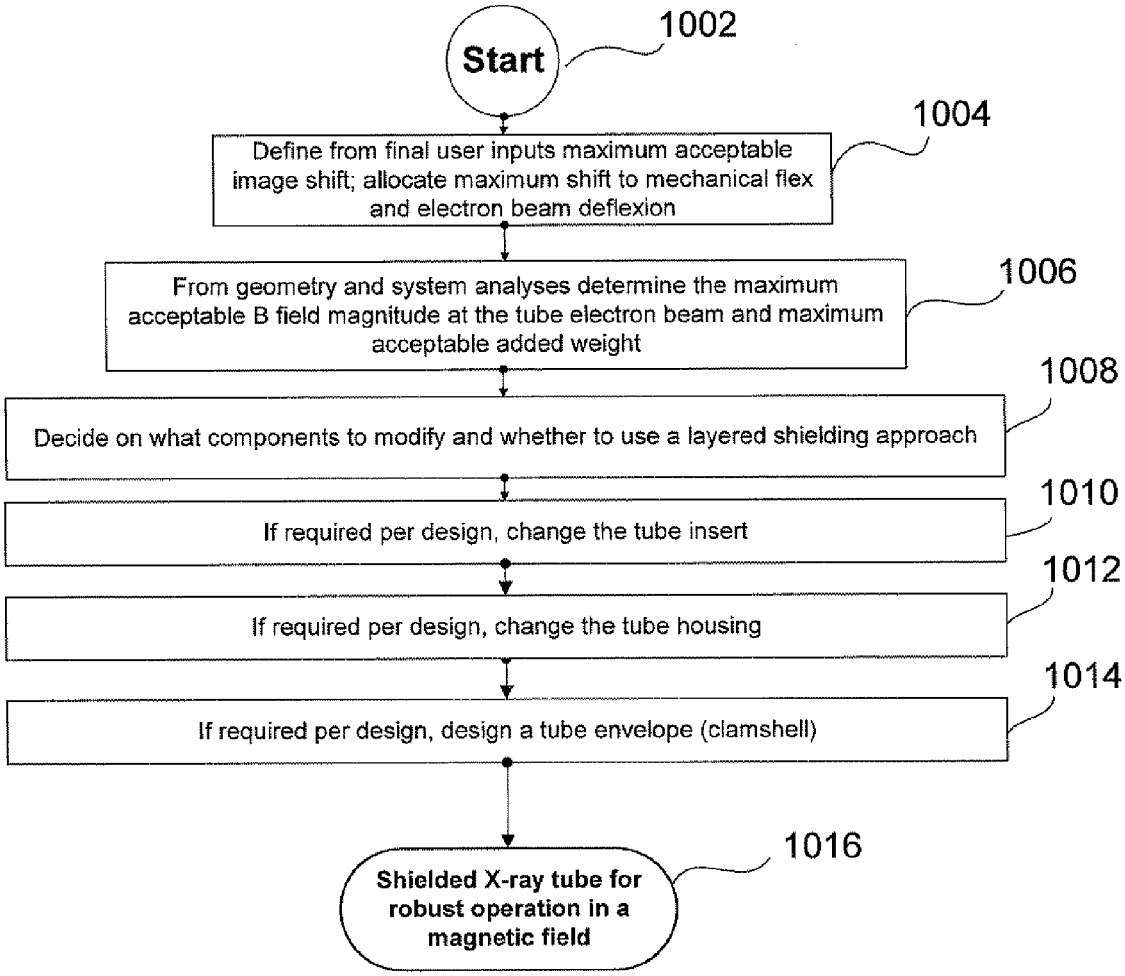
FIG. 10 presents a flowchart for the analysis of a specific operating environment and the design of a passively shielded x-ray tube suitable for robust operation within the environment according to the principles of the present invention.

FIG. 10 presents a flowchart 1002 of the present invention methods. The first step 1004 in designing an x-ray tube for use in a magnetic environment is to obtain a specification of the maximum image shift acceptable to the end users. Based upon this key input and an x-ray system design specifications, the maximum field magnitude that can be present within the insert in-between the cathode and the anode is determined, step 1006. Given a map of the externally applied field magnitudes and directions surrounding the x-ray tube when in operation in the combined system, a determination of the amount of total magnetic attenuation necessary can be made. This determination in turns serves as input to the specific shielding design 1008. Considerations of mechanical structure strengths, materials masses, magnetic, thermal and mechanical characteristics then guide the design and help decide which x-ray tube component(s) to modify. Most magnetically and mechanically efficient is a re-design of the tube insert 1010; however the insert is subject to high thermal and mechanical stresses and can be expensive to redesign. Next in terms of magnetic efficiency is the tube housing 1012, followed by an external shield 1014. For obtaining maximum shielding power at 1016, it is desirable to select at least two layers to be made of a high permeability material; such combinations include (insert, housing), (housing, external shell), and (insert, external shell). The most demanding applications might require the use of three layers.

Figure 11:
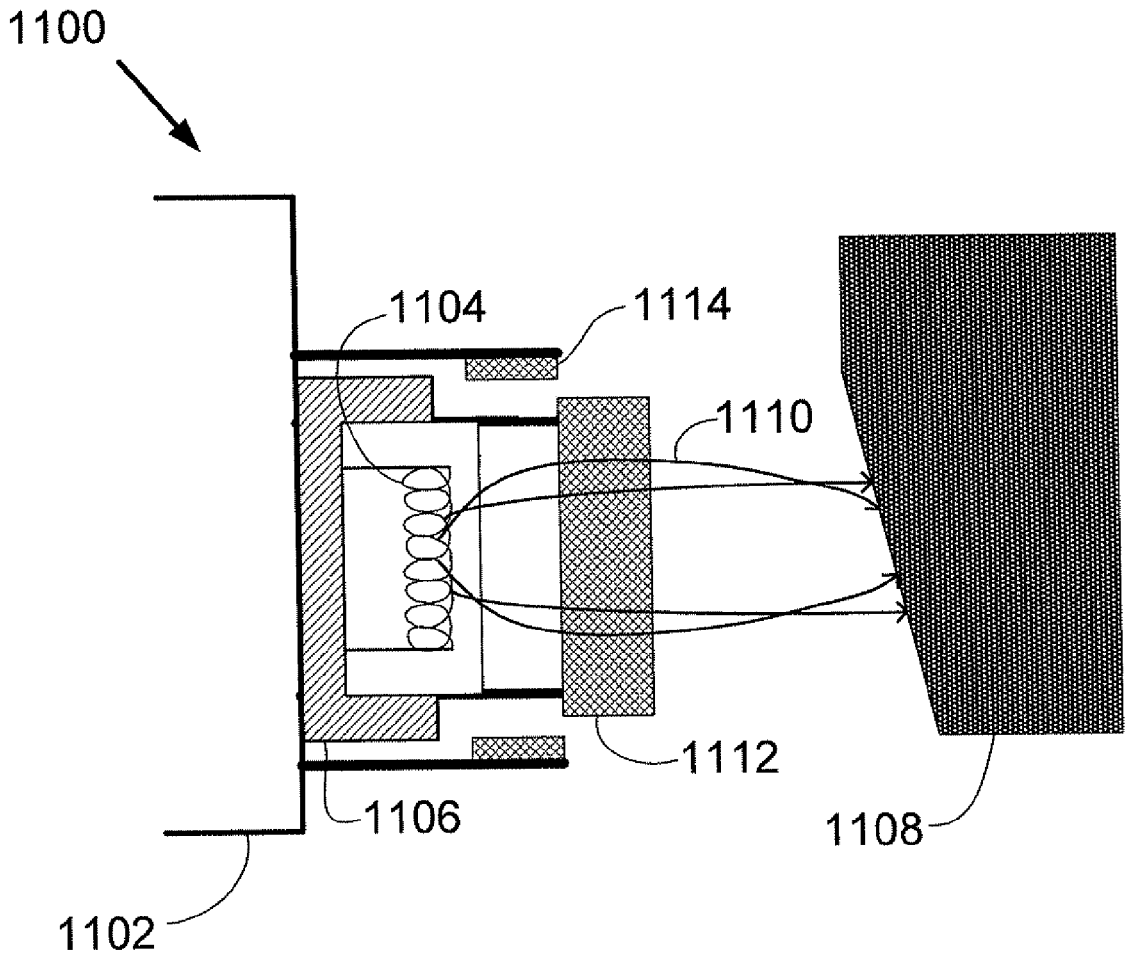
FIG. 11 presents a modified electron beam optics electrostatic subsystem for active compensation for the effect of a magnetic field.

FIG. 11 presents 1100 in cross-section a means to actively compensate for the effect of an electromagnetic field though the use of modified electron beam optics. The cathode 1102 comprises a tube filament 1104 surrounded by a focusing cup 1106 to which various voltages can be applied. When the filament 1104 is heated by passage of a tube current, electrons are "boiled off" and attracted to the anode 1108 through various beam trajectories 1110. The modified sub-system includes electrostatic means 1112 and 1114 of deflecting the electron beam along two orthogonal axes through the application of time-dependent electric fields. The fields are determined from magnetic field measurements that determine the amount of residual magnetic field present within the insert frame as disclosed in prior art. The effect of the fields is to actively oppose the beam deflection caused by the residual magnetic fields. The active methods of shielding the tube can be employed in combination with the passive shield methods described in this invention. In particular, the electrostatic shielding method can be used in conjunction with any of the passive shielding methods disclosed by the present invention.

The advantages of the above described embodiments and improvements should be readily apparent to one skilled in the art, as to enabling the magnetic shielding of an x-ray tube or the design of a modified x-ray tube to include magnetic shielding for robust operation in static and dynamic external magnetic fields. Additional design considerations may be incorporated without departing from the spirit and scope of the invention. Accordingly, it is not intended that the invention be limited by the particular embodiment or form described above, but by the appended claims.

What is claimed is:

1. A method for the design of an x-ray tube passively shielded from an externally applied magnetic field, comprising: (a) selecting magnetically permeable materials suitable for the design of at least two of the group of x-ray tube components consisting of an x-ray tube insert frame, an x-ray tube housing, an x-ray tube external shield envelope, an x-ray tube port, and an x-ray tube scatter cone; and (b) combining the x-ray tube components of step (a) with x-ray tube components made of non-permeable materials to obtain an x-ray tube that shields the space between an insert cathode and an insert anode from an externally applied magnetic field, and (c) determining the maximum acceptable magnetic field within the x-ray tube insert; (d) determining the maximum externally applied magnetic field magnitude; and (e) determining the maximum shielded tube weight; whereby the x-ray tube design meets the weight constraints of step (e) and the reduced field within the insert frame is less than the maximum of step (c) when the x-ray tube is subjected to an externally applied field of magnitude less than that of the maximum of step (d).

2. The method of claim 1, wherein the step (a) of selecting magnetically permeable materials suitable for the design further comprises selecting at least two materials with different permeability and magnetic saturation properties.

3. The method of claim 2, wherein the at least two materials are selected to form a layered magnetic shield.

4. The method of claim 3, wherein the material selected for the outer shield layer has higher magnetic saturation than the material selected for the inner shield layer.

* * * * *